United States Patent [19]

Niinuma

[11] 4,360,721

[45] Nov. 23, 1982

[54] PUSH BUTTON SWITCH WITH ALTERNATE ACTION MECHANISM

[75] Inventor: Akira Niinuma, Furukawa, Japan

[73] Assignee: Alps Electric Co., Ltd., Tokyo, Japan

[21] Appl. No.: 234,902

[22] Filed: Feb. 17, 1981

[30] Foreign Application Priority Data

Mar. 5, 1980 [JP] Japan ..... 55-28626[U]

[51] Int. Cl.[3] ..... H01H 13/56

[52] U.S. Cl. ..... 200/153 J; 200/153 J

[58] Field of Search ..... 200/153 J, 328, 252

[56] References Cited

U.S. PATENT DOCUMENTS

| | | | |
|---|---|---|---|
| Re. 27,836 | 12/1973 | Hansen . | |
| 3,624,328 | 12/1971 | Hansen . | |
| 3,707,610 | 12/1972 | Davies | 200/153J |
| 3,732,386 | 5/1973 | Ohkita . | |
| 3,914,570 | 10/1975 | Lockard . | |
| 4,137,438 | 1/1979 | Sato | 200/252 |
| 4,160,143 | 7/1979 | Schlesier et al. | 200/153 J |

*Primary Examiner*—John W. Shepperd

*Attorney, Agent, or Firm*—Guy W. Shoup; Gerard F. Dunne

[57] ABSTRACT

A push button switch with an alternate action mechanism having a heart cam groove formed in the manipulation rod slidably received by a case. The longitudinal side wall of the heart cam groove is formed by the side wall of the case, so as to permit the width of the heart cam mechanism to be reduced considerably.

2 Claims, 3 Drawing Figures

PUSH BUTTON SWITCH WITH ALTERNATE ACTION MECHANISM

BACKGROUND OF THE INVENTION

The present invention relates to a push button switch provided with an alternate action mechanism.

Generally, known alternate action mechanisms include a so-called heart cam groove formed in the manipulation lever of the push button switch, and a substantially Z-shaped driving pin arranged for engagement with the heart cam groove during movement of the manipulation lever. This known type of alternate action mechanism is described, for example, in the specification of the U.S. Pat. No. 3,732,386.

In order to ensure safe alternate action of such a switch, the heart cam groove is required to have a suitable size. For instance, as disclosed in the specification of the U.S. Pat. No. 3,624,328, the heart cam is apt to have a width greater than the width of the outer end of the manipulation lever. Therefore, any attempt for reducing the width of the push button switch is often restricted undesirably by the necessary width of the heart cam groove.

SUMMARY OF THE INVENTION

It is, therefore, an object of the invention to provide a push button switch provided with an alternate action mechanism of a reduced size.

Another object of the invention is to provide a push botton switch which can be suitably used in a multi-push button switch in which a multiplicity of push button switches are arranged in side-by-side relation and constructed as a unit.

Other objects and advantages of the invention will become clear from the following description of the preferred embodiment taken in conjunction with the accompanying drawings.

DESCRIPTION OF THE PREFERRED EMBODIMENT

Figure 1:
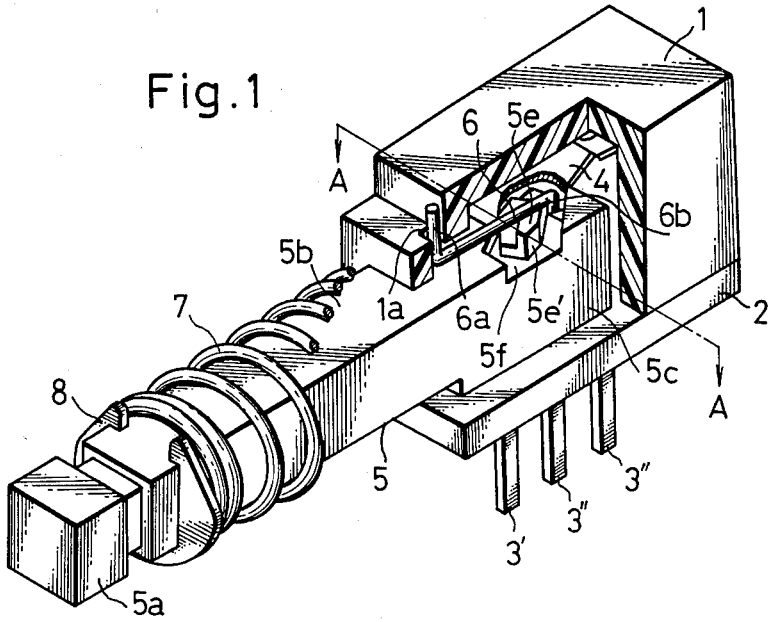
FIG. 1 is a partly sectioned perspective view of a push button switch constructed in accordance with an embodiment of the invention.

Referring to the drawing, a reference numeral 1 designates a substantially inverted U-shaped case having a pin bore 1*a* formed therein and adapted for pivotally supporting one end of a driving pin which will be mentioned later. A plate-shaped substrate 2 is made of an electrically insulating material and held to the open bottom of the case 1.

Reference numerals 3', 3'' and 3''' denote terminals fixed to penetrate the substrate 2. A leaf spring 4 made of a resilient material is fixed in the case 1 in such a manner so as to urge the aforementioned driving pin downwardly. A manipulation rod 5 has an outer manipulating portion 5*b* and a slide block 5*c*. A recess for accomodating a slide 9 is formed at the reverse side of the block 5*c*. A heart-shaped cam 5*e* and a heart cam groove 5*f* are formed on the upper side of the manipulation rod 5. Also, a retainer groove 5*g* for engagement by a retainer plate 8 retaining a spring is formed in the shaft portion 5*b* of the manipulation rod 5. A reference numeral 6 denotes a driving pin which is formed by bending a linear pin into a Z-like shape.

One bent end 6*a* of the driving pin 6 is pivotally received by the aforementioned pin bore 1*a* formed in the case 1, whereas the other bent end 6*b* makes an engagement with the heart cam groove 5*f*, and is urged by the leaf spring 4 into contact with the bottom of the heart cam groove.

A reference numeral 7 designates a spring which is inserted into the shaft portion 5*b* of the manipulation rod 5 to urge the latter in the direction opposite to the direction of depression. A retainer plate 8 fitting and engaging the retainer groove 5*g* formed in the shaft 5*b* retains one end of the spring 7.

Figure 2:
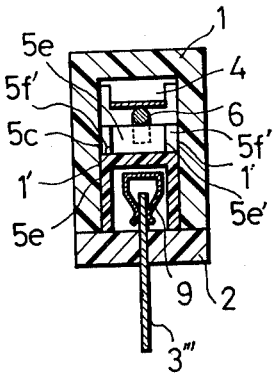
FIG. 2 is a sectional view taken along the line A—A of FIG. 1.

Referring particularly to FIG. 2, a slide 9 is mounted in the recess formed in the lower portion of the slide block 5*c* in such a manner as to be able to clamp the terminals 3' to 3'''.

In the lock type push button switch having the described construction, as the manipulating portion 5*a* of the manipulation rod 5 is depressed overcoming the force of the spring 7, the slide 9 slides in the direction of the depressing force as a unit with the slide block 5*c* to switch the electric connection between a plurality of terminals 3' to 3'''. Then, the slide 5*c* is locked in the depressed state by the cooperation between the heart cam groove 5*f* and the driving pin 6, as is well understood in the art.

This locking is released as the manipulating portion 5*a* is depressed again and then released. In consequence, the side block is reset to the starting position by the force of the spring 7 to recover the initial state of the electric connection of the terminals 3', 3'' and 3'''.

Figure 3:
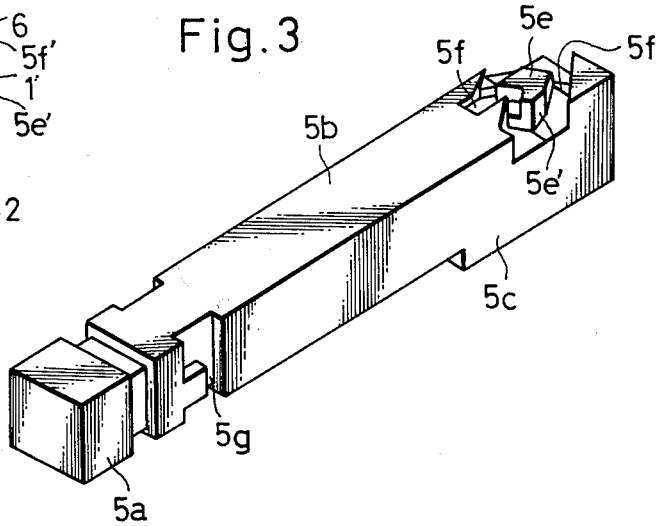
FIG. 3 is a perspective view of the manipulation lever of a push button switch embodying the present invention.

It is to be pointed out here that, the pin end 6*b* is guided in the cam groove 5*f* by the side walls forming the cam groove. According to the invention, the pin guide wall extending in the longitudinal direction of the manipulation rod 5 is formed by side wall portions of the inner surface of the case 1 and not by wall portions of the manipulation rod. As shown in FIG. 3, this is accomplished by eliminating lateral portions of the manipulation rod 5 that otherwise would define the cam groove and the inner peripheral surface of the case 1 thus acts as this longitudinal pin guide wall. The heart cam portion 5*e* formed on the manipulation rod 5 is shown in detail in FIG. 3. Therefore, according to the invention, it is possible to make the width of the slide block 5*c* and that of the shaft portion 5*b* equal to each other. In other words, it is possible to reduce the width of the slide block and several switches could thus be arranged quite compactly in side-by-side relation.

What is claimed is:

1. In a push button switch with an alternate action mechanism comprising a manipulation rod having a slide block mounting a slide and provided with a heart cam formed in the upper surface thereof, a case having a plurality of terminals fixed thereto and adapted to slidably support said slide block, and a substantially Z-shaped driving pin pivotally supported at its one end by said case and adapted to move at its other end along said heart cam, whereby, as said manipulation rod is depressed, said slide block is slid to change the electric connection between said terminals, and said manipulation rod is locked in the depressed state by a cooperation of between said driving pin and said heart cam, an improvement which comprises that the lateral wall of the heart cam groove constituting said heart cam in said slide block extending in the logitudinal direction of said manipulation rod is formed by the inner peripheral surface of said case.

2. A push button switch according to claim 1, wherein said slide block has a width equal to that of said manipulation rod.

* * * * *